US005575456A

United States Patent [19]

Raphael, III

[11] Patent Number: 5,575,456

[45] Date of Patent: Nov. 19, 1996

[54] LEVER OPERATED HOIST

[75] Inventor: Julian J. Raphael, III, Abingdon, Va.

[73] Assignee: Columbus McKinnon Corporation, Amherst, N.Y.

[21] Appl. No.: 489,532

[22] Filed: Jun. 12, 1995

[51] Int. Cl.[6] ..... B66D 3/14

[52] U.S. Cl. ..... 254/345; 74/337.5; 192/93 A; 192/95; 242/263; 254/352

[58] Field of Search ..... 254/345, 352, 254/365; 74/337.5, 405, 421 A; 242/263, 255; 192/93 A, 95, 20

[56] References Cited

U.S. PATENT DOCUMENTS

| | | | |
|---|---|---|---|
| 15,466 | 8/1856 | Bailey . | |
| Re. 33,898 | 4/1992 | Santos | 114/210 |
| 1,018,970 | 2/1912 | Gardiner . | |
| 1,163,169 | 12/1915 | Pavelka . | |
| 1,359,517 | 11/1920 | Martinusen et al. . | |
| 2,162,962 | 6/1939 | Messer | 254/187 |
| 2,450,605 | 10/1948 | McIntyre | 254/187 |
| 2,503,146 | 4/1950 | Anketell | 74/405 |
| 2,553,031 | 5/1951 | Benson et al. | 254/187 |
| 2,559,450 | 7/1951 | Mayer | 254/345 |
| 3,100,031 | 8/1963 | Lock | 254/352 |
| 3,626,499 | 12/1971 | Iwama | 254/345 |
| 3,766,795 | 10/1973 | Priest et al. | 74/405 |
| 3,889,773 | 6/1975 | Chant | 180/65 R |
| 4,003,270 | 1/1977 | Moosberg | 74/405 |
| 4,159,050 | 6/1979 | Hopkins, Sr. et al. | 192/93 A |
| 4,251,060 | 2/1981 | Suzuki et al. | 254/5 |
| 4,319,495 | 3/1982 | Salicini | 74/405 |
| 4,420,144 | 12/1983 | Nishimura | 254/345 |
| 4,566,674 | 1/1986 | Ebey et al. | 254/345 |
| 4,696,382 | 9/1987 | Aho | 192/93 A |
| 4,930,719 | 6/1990 | Sehl | 242/86.5 |
| 4,974,814 | 12/1990 | Cundy | 254/345 |
| 5,020,737 | 6/1991 | Sehl | 242/86.5 |
| 5,245,882 | 9/1993 | Kallenberger et al. | 74/405 |

FOREIGN PATENT DOCUMENTS

| | | | |
|---|---|---|---|
| 1017569 | 10/1957 | Germany | 254/345 |

*Primary Examiner*—Katherine Matecki
*Attorney, Agent, or Firm*—Bean, Kauffman & Spencer

[57] ABSTRACT

A lever operated tool, such as a chain hoist, is provided with a free wheel mechanism allowing a lift wheel to be selectively disconnected relative to a driving gear in response to rotations of a manual control knob. The knob controls sliding movement of a driven gear mounted for rotation with the lift wheel between first and second positions in which it is engaged with and removed from engagement with the driving gear.

9 Claims, 3 Drawing Sheets

FIG. 2
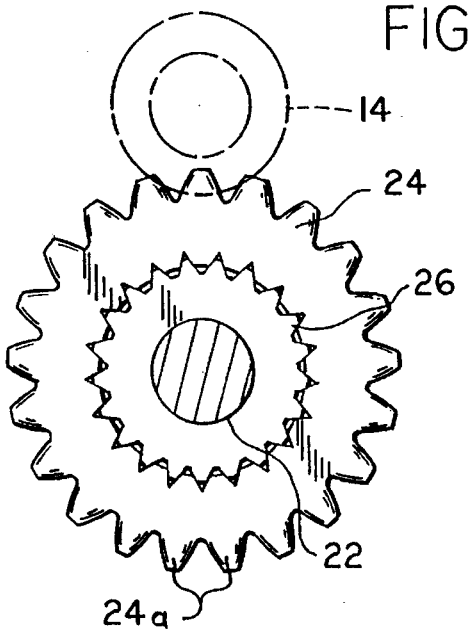
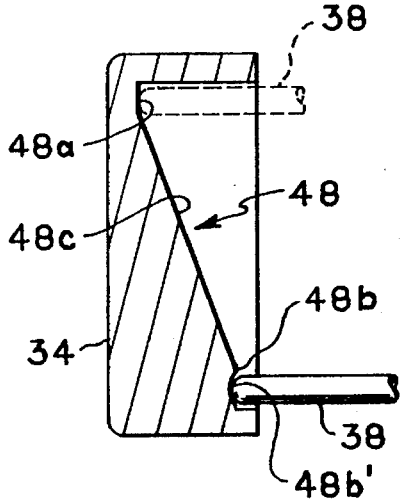
FIG. 6
FIG. 3
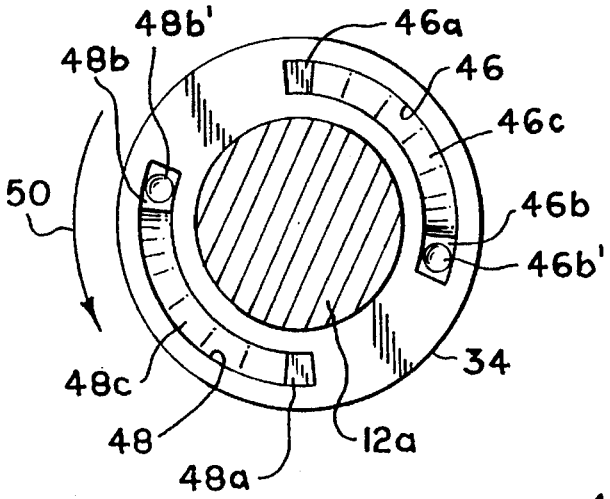
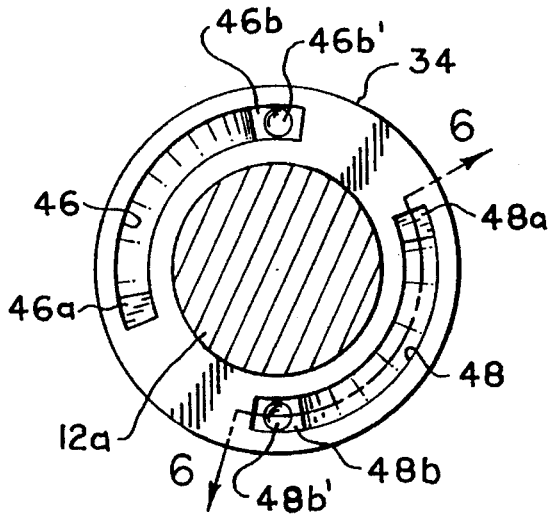
FIG. 5

LEVER OPERATED HOIST

BACKGROUND OF THE INVENTION

It is known to provide lever operated tools, such as chain hoists, with free wheel mechanisms, which allow a lift wheel to be selectively disconnected from a tool drive mechanism in order to permit a load lift chain to be readily drawn through the tool.

SUMMARY OF THE INVENTION

The invention is directed to a lever operated tool, such as a hoist, fitted with a free wheel mechanism by which a lift wheel is selectively disconnected or drivingly uncoupled relative to a drive gear coupled in turn for rotation by a manually operated lever.

The mechanism includes a driven gear mounted for rotation with the lift wheel and for axial sliding movement relative thereto between first and second positions in which the driven gear is engaged with and disengaged from the drive gear, respectively.

A compression type return spring opposes movement of the driven gear from its first position into its second position and biases the driven gear for return to its first position. Movement of the driven gear between its positions is controlled by a rotatably supported manually operable knob having a pair of cam tracks and a pair of compression pins, which have their opposite ends slidably engaged with the driven gear and cam tracks.

BRIEF DESCRIPTION OF THE DRAWINGS

The nature and mode of operation of the present invention will now be more fully described in the following detailed description taken with the accompanying drawings wherein:

FIG. 2 is a sectional view taken generally along the line 2—2 in FIG. 1;

FIG. 3 is a sectional view taken generally along the line 3—3 in FIG. 1;

FIG. 5 is a view similar to FIG. 3, but showing the knob rotated sufficiently to disconnect the driven gear from engagement with the drive gear; and FIG. 6 is a sectional view taken generally along the line 6—6 in FIG. 5.

DETAILED DESCRIPTION

Figure 1:
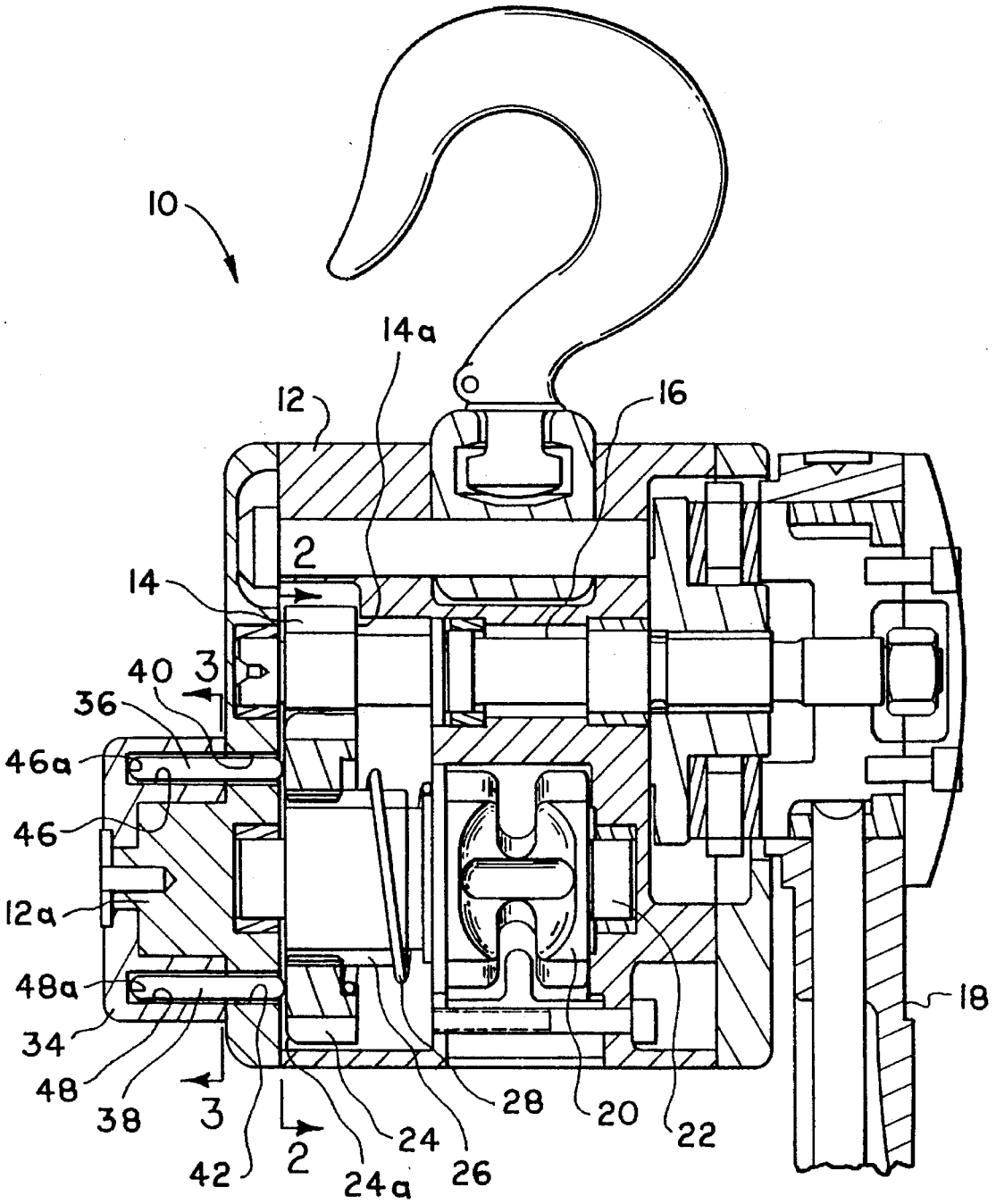
FIG. 1 is a vertical sectional view of a lever operated tool showing the free wheel mechanism of the present invention with a lift wheel operably connected with a drive gear.

Reference is first made to FIG. 1, wherein a lever operated tool, such as a lever operated chain hoist, is generally designated as 10 and shown as comprising in combination a tool casing 12; a drive gear 14 carried by a casing supported rotatable drive or input shaft 16; a manually operable lever 18 coupled to the drive shaft to effect rotation of the drive gear in response to swinging movements of the lever relative to the casing; a lift wheel 20 carried by a casing supported rotatable driven or output shaft 22; and a driven gear 24 supported for rotation with the driven shaft and arranged for driven engagement with the drive gear, whereby to effect driven rotations of the lift wheel in response to swinging movements of the lever. As thus far described, tool 10 is of known or conventional construction.

The present invention contemplates fitting tool 10 with a free wheel mechanism, which permits lift wheel 20 to be selectively uncoupled relative to drive gear 14, so as to allow free rotations of the lift wheel as required to permit a load lift chain, not shown, which is trained over the lift wheel, to be readily drawn through the tool.

Figure 4:
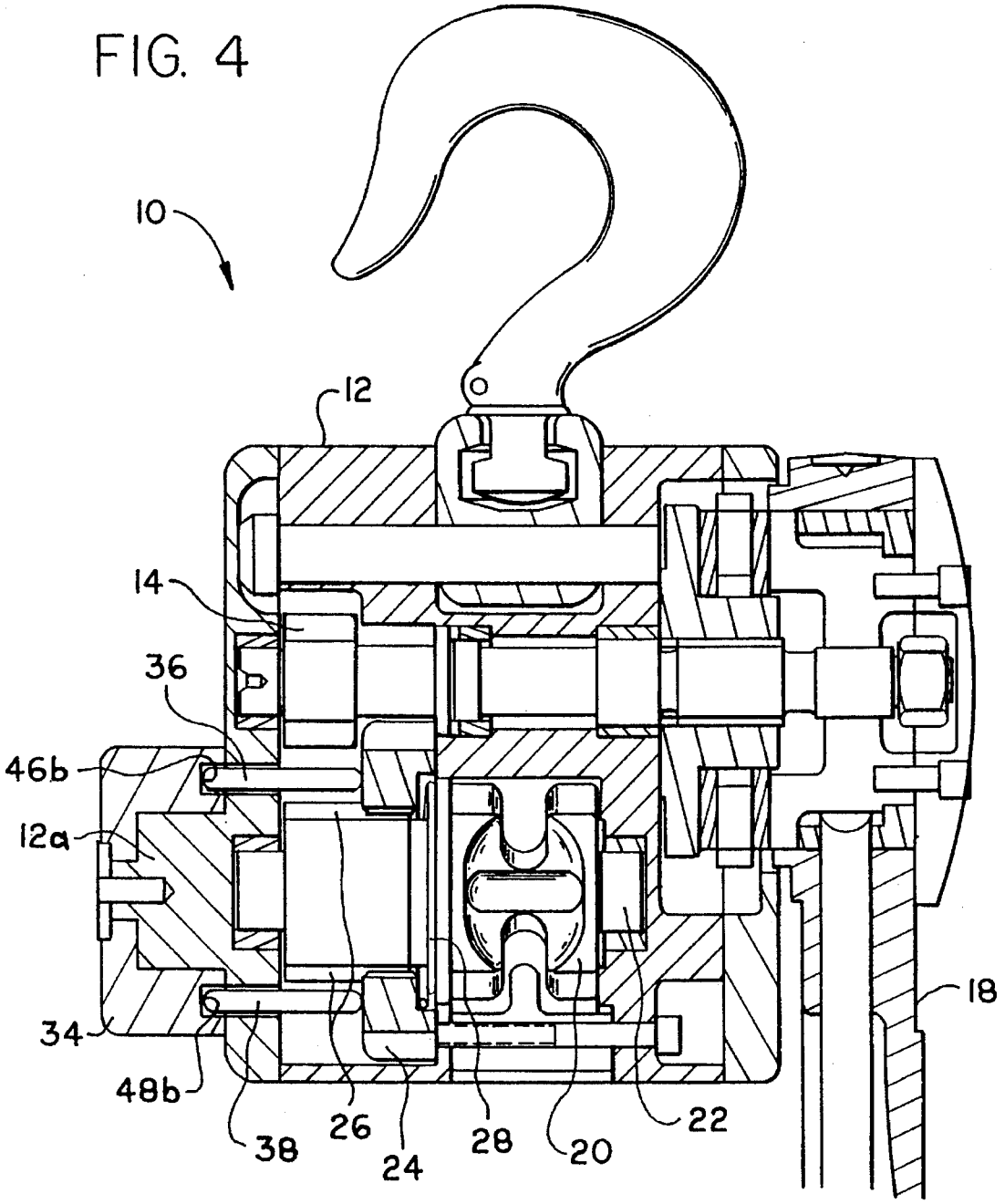
FIG. 4 is a view similar to FIG. 1, but showing the lift wheel operably disconnected relative to the drive gear.

In accordance with the preferred form of the present invention, driven shaft 22 is constrained against any significant axial displacement and driven gear 24 is mounted on the driven shaft by means of a spline connection 26, which serves to mount the driven gear for rotation with the driven shaft, while allowing sliding movement of the driven gear axially of the driven shaft between first and second positions shown in FIGS. 1 and 4, respectively. In the first or normal position of driven gear 24, it is coupled or disposed in driven engagement with drive gear 14 and in the second position of the driven gear it is displaced axially of driven shaft 22 sufficiently to completely remove the driven gear from contact with the drive gear, whereby to allow free wheeling of lift wheel 20. A coil type compression or return spring 28 is arranged concentrically of driven shaft 22 and serves to resiliently oppose movement of driven gear 24 from its first position towards its second position and then to bias the driven gear for return to its first position. Preferably, the edges **24*a* of the teeth of driven gear 24, which lead in the direction of return movement of the driven gear are rounded and outwardly inclined or beveled in order to facilitate their re-engagement with the teeth of drive gear 14 incident to return of the driven gear to its first position. If desired, the edges 14*a* of the teeth of drive gear 14, which will engage with tooth edges 24*a***, may be similarly rounded and outwardly inclined or beveled.

Sliding movements of driven gear 24 are controlled by a manually operable control knob 34, which is supported exteriorly of casing 12 on a casing bearing extension **12*a* for rotation about an axis disposed essentially in alignment with the rotational axis of driven shaft 22; and a pair of parallel compression pins 36 and 38, which are slidably supported within a pair of casing bearing openings 40 and 42 such that the opposite ends of the pins are arranged for sliding engagement with cam track means of the control knob to be described and driven gear 24, as best shown in FIGS. 1 and 4**.

In a presently preferred and illustrated construction, the cam track means of control knob 34 consists of a pair of annularly spaced track sections 46 and 48 arranged to slidably receive outwardly projecting ends of compression pins 36 and 38, respectively, as the knob is rotated relative to bearing extension **12*a* between its normal and operative rotatable positions shown in FIGS. 3 and 5, respectively. Track sections 46 and 48 include first ends 46*a* and 48*a*, second ends 46*b* and 48*b*, and annularly extending inclined surfaces or portions 46*c* and 48*c*** arranged to extend between their associated first and second ends.

Preferably, first ends **46*a* and 48*a* are disposed essentially in a first common plane extending normal to the axis of rotation of knob 34 and axially spaced from driven gear 24, when the latter is in its first position, through a distance corresponding to the lengths of compression pins 36 and 38. Thus, when knob 34 is in its normal rotatable position shown in FIGS. 1 and 3, return spring 28 biases driven gear 24 to assume its first position, which in the illustrated form of the invention is determined by the seating of the driven gear in engagement with the inner ends of compression pins 36 and 38 and the seating of the outer ends of such pins in engagement with cam track first ends 46*a* and 48*a*. However, if desired, other suitable means, such as for example an end thrust bearing for driven gear 24, may be employed to determine the first position of driven gear 24, that is, to define the limit of its movement to the left as viewed in FIG. 1, such that compression pins 36 and 38 are not subjected to axial compressive stress and frictional sliding contact between the driven gear and the inner ends of the compression pins is thereby eliminated or minimized while the driven gear is disposed for driven rotation by drive gear 14**.

Cam track second ends 46*b* and 48*b* are shown as being disposed essentially in a second plane extending normal to the axis of rotation of knob 34 and arranged axially intermediate first ends 46*a* and 48*a* and driven gear 24. The axial distance between these first and second ends of cam track sections 46 and 48 corresponds to the axial distance to be traveled by driven gear 24 between its first and second positions for the illustrated form of the invention, where the first position is determined by engagement of the driven gear with compression pins 36 and 38 and engagement of such pins with first ends of the cam track sections. If means other than cooperative engagement of first ends 46*a* and 48*a*, pins 36 and 38, and driven gear 24, such as that mentioned for example above, is employed to determine the first position of driven gear 24, then the axial distance between the first ends and second ends would necessarily be slightly greater than the distance required to be traveled by the driven gear between its first and second positions.

When knob 34 is manually rotated away from its normal rotatable position shown in FIGS. 1 and 3 in the direction designated by arrow 50 in FIG. 3, inclined cam surfaces 46*c* and 48*c* are brought into engagement with the outwardly projecting ends of compression pins 36 and 38 and thereby serve to move or drive the pins to the right as viewed in FIG. 1 until such time as second ends 46*b* and 48*b* are brought into engagement with the pins to define the second position of driven gear 24 shown in FIG. 4. The alternative positions assumed by the compression pins when knob 34 is disposed in its normal and operable rotatable positions shown in FIGS. 3 and 5, respectively, are best shown for the case of pin 38 in FIG. 6, where broken and full lines are employed to illustrate such alternative positions.

In accordance with the present invention, suitable locking means are employed to releasably lock driven gear 24 in its second position against the return bias of return spring 28. In the illustrated and presently preferred construction, such locking means includes locking recesses 46*b*' and 48*b*' defined by cam track second ends 46*b* and 48*b*, as best shown in FIGS. 3, 5 and 6, and sized to removably receive the outwardly projecting ends of compression pins 36 and 38. Thus, when knob 34 is rotated into its operable rotatable position shown in FIGS. 4 and 5, compression pins ride into recesses 46*b*' and 48*b*' and are thereafter retained therewithin under the bias of return spring 28. Pins 36 and 38 can be removed from locking engagement with recesses 46*b*' and 48*b*' only when sufficient force is applied to knob 34, as required to cause the pins to ride out of the recesses against the bias of return spring 28.

In the preferred Construction of the invention, knob 34 is formed with two cam track sections 46 and 48 such that the knob must be rotated in opposite directions incident to movement thereof from and for return to its initial or normal rotatable position shown in FIGS. 1 and 3. It is contemplated, however, that knob 34 may be formed with a continuous annular trackway defined by joining first end 46*a* to second end 48*b* and first end 48*a* to second end 46*b* by a pair of inclined cam surfaces or portions, not shown, for which case the knob could be rotated in opposite directions for purposes of moving same between its normal and operable positions, or ratchet means, not shown, could be provided to limit knob rotation to a single direction. These and other similar modifications may be incorporated within the present free wheel mechanism without departing from the present invention.

What is claimed is:

1. In a lever operated tool including a drive gear mounted upon a rotatable drive shaft, a driven gear mounted together with a lift wheel on a rotatable driven shaft, a casing supporting said shafts, and a lever for imparting driving rotation to said drive gear thereby to impart driven rotation to said lift wheel via said driven wheel, the improvement for permitting free wheeling of said lift wheel comprising in combination:

means for supporting said driven gear for movement in a direction aligned with an axis of rotation of said driven shaft from a first position in which said driven gear is disposed in driven engagement with said drive gear and a second position in which said driven gear is removed from driven engagement with said drive gear;

resilient means providing a bias tending to maintain said driven gear in said first position;

a manually operated knob rotatably supported exteriorly of said casing for movement between normal and operable rotatable positions and having a cam track means displaceable incident to rotation of said knob between said rotatable positions thereof;

compression pin means slidably supported by said casing and having an inner end arranged for sliding engagement with said driven wheel and an outer end arranged for sliding engagement With said cam track means, said track means moving said pin means to effect movement of said driven gear from said first position into said second position against said bias incident to rotation of said knob from said normal position into said operable position, and said track means allowing movement of said driven gear from said second position into said first position under said bias incident to rotation of said knob from said operable position into said normal position; and locking means for releasably retaining said driven gear in said second position.

2. A lever operated hoist according to claim 1, wherein said knob is rotatable in opposite directions between said normal and operable positions.

3. A lever operated hoist according to claim 1, wherein said knob is rotatable about an axis disposed essentially coincident with said axis of rotation of said driven shaft, and said pin means includes a pair of parallel pins.

4. In a lever operated tool having a drive gear carried on a drive shaft, a driven gear and a load lift wheel carried on a driven shaft, a casing for supporting said shafts interiorly thereof, and a mechanism providing for free wheeling of said load lift wheel, said mechanism comprising in combination:

means supporting said driven gear on said driven shaft for rotation with said load lift wheel and for relative movement axially of both said driven shaft and said load lift wheel between a first position of engagement With said drive gear and a second position removed from engagement with said drive gear;

resilient means;

manual control means for moving said driven gear from said first position into said second position, said resilient means tending to return said driven gear to said first position from said second position; and locking means for releasably retaining said driven gear in said second position.

5. A hand operated tool comprising:

a casing;

a drive gear carried by a casing supported rotatable drive shaft;

a manually operated lever coupled to said drive shaft for rotating said drive gear;

a lift wheel carried by a casing supported rotatable driven shaft;

a driven gear supported by said driven shaft for rotation therewith and for relative sliding movement axially thereof between a first position in which said driven gear engages with said drive gear and a second position in which said driven gear is spaced from engagement with said drive gear;

a manually operable knob rotatably supported externally of said casing and having annular cam track means formed with annularly spaced first and second ends differently spaced axially from said driven gear and annularly extending inclined portions arranged to extend between said first and second ends;

a pair of parallel compression pins slidably supported by said casing and having opposite ends thereof arranged for sliding engagement with said cam track means and said driven gear, said first end of said cam track means being spaced axially from said driven gear when in said first position thereof through a distance corresponding essentially to the length of said pins, said second end of said cam track means being arranged axially intermediate said first end of said cam track means and said driven gear with the axial distance between said first and second ends of said cam track means corresponding at least to the axial distance required to be traveled by said driven gear between said first and second positions; and a return spring resiliently opposing movement of said driven gear from said first position into said second position and tending to return said driven gear to said first position.

6. A hand operated tool according to claim 5, wherein locking means are provided to releasably retain said driven gear in said second position.

7. A hand operated tool according to claim 5, wherein said second end of said cam track means includes a locking recess means for removably receiving said compression pins, and said return spring releasably maintains said pins seated within said recess means for releasably retaining said driven gear in said second position.

8. A hand operated tool according to claim 5, wherein said cam track means includes a pair of annularly spaced track sections arranged for engagement one with each of said compression pins, each of said track sections including a first end, a second end and an inclined portion, and said knob is rotatable in opposite directions to alternately effect movement of said driven gear from said first position to said second position and allow said return spring to effect movement of said driven gear from said second position to,said first position.

9. A hand operated tool according to claim 8, wherein the second ends of said track sections are aligned and extend generally transversely of an axis of rotation of said knob relative to said casing, each of said second ends includes a locking recess for removably receiving an end of one of said compression pins, and said return spring releasably maintains said pins seated within the locking recess of their associated track sections for releasably retaining said driven gear in said second position.

* * * * *